United States Patent [19]

Seehase

[11] Patent Number: 4,551,937

[45] Date of Patent: Nov. 12, 1985

[54] RECOIL PAD UTILIZING STRUTS DISPOSED AT A COMPOUND ANGLE AND HAVING ADJUSTABLE ENERGY-ABSORBING CHARACTERISTICS

[76] Inventor: Jack C. Seehase, 1200 Osceola Ave., Winter Park, Fla. 32789

[21] Appl. No.: 719,223

[22] Filed: Apr. 2, 1985

Related U.S. Application Data

[63] Continuation-in-part of Ser. No. 577,263, Feb. 6, 1984, abandoned.

[51] Int. Cl.[4] ..... F41C 23/00

[52] U.S. Cl. ..... 42/74

[58] Field of Search ..... 42/1 V, 71 R, 74

[56] References Cited

U.S. PATENT DOCUMENTS

| | | | |
|---|---|---|---|
| 1,729,514 | 9/1929 | Lorimer | 42/74 |
| 1,805,273 | 5/1931 | Ammann | 42/74 |
| 2,468,349 | 4/1949 | Stewart | 42/74 |
| 3,267,602 | 8/1966 | Miller | 42/74 |

*Primary Examiner*—Charles T. Jordan
*Assistant Examiner*—Ted L. Parr
*Attorney, Agent, or Firm*—Julian C. Renfro

[57] ABSTRACT

An adjustable shoulder pad for use on the end of the stock of a rifle or shotgun, containing a number of generally parallel, elongate slots of essentially consistent size and configuration, extending from side to side through the pad. These slots define a number of struts that angle downwardly at a compound angle, that is, slots that are in an angular relationship to each of two planes that are orthogonally disposed. One of such planes is the one in which the bullet or shot is to travel, whereas the other plane extends laterally away from the shooter. The struts defined by these slots tend to bend and buckle somewhat at the time the shooter places my adjustable shoulder pad against a designated shoulder, so as to cause the pad to conform to the configuration of his shoulder. Further tendency of the struts to buckle is encountered at the time the gun is fired. The amount of energy to be absorbed by my novel pad can be selectively varied by the user, who can insert a desired number of strips, such as of an elastomer, into such slots, thereby to lessen the tendency of said struts to buckle. The preferred material for the adjustable shoulder pad is an elastomer containing a large number of tiny, closed cell bubbles.

20 Claims, 11 Drawing Figures

RECOIL PAD UTILIZING STRUTS DISPOSED AT A COMPOUND ANGLE AND HAVING ADJUSTABLE ENERGY-ABSORBING CHARACTERISTICS

RELATIONSHIP TO EARLIER INVENTION

This invention bears a definite relationship to my earlier invention entitled "Recoil Pad for Rifle or Shotgun", Ser. No. 522,022, filed Aug. 11, 1983, abandoned, and is a continuation-in-part of my invention "Recoil Pad Providing Adjustable Energy-Absorbing Characteristics", Ser. No. 577,263, filed Feb. 6, 1984, now abandoned.

BACKGROUND OF THE INVENTION

In the past a large number of recoil pads or butt plates have been provided on the end of the stock of rifles or shotguns, these being principally used to lessen the forces to be absorbed by the shoulder of the shooter.

Unfortunately, these prior art shoulder pads have failed to provide all of the shock absorption desired, for the material utilized must be sufficiently tough and tear resistant as to prevent disintegration of the pad after the gun has been fired a number of times, as well as being exposed to the elements. I have found that pads durable enough as not to undergo early disintegration have been comparatively unyielding, with the result that there has been little attenuation of the shock from the gun being fired. Also, the shooter could not adjust the energy-absorbing characteristics of these prior art shoulder pads.

Consequently, it was one of the goals of my new shock absorber shoulder pad to enable the shooter to adjustably attenuate the kick of the gun.

In addition, it is to be realized that when a gun is fired, the extremely high gas pressure created inside the barrel equalizes, and the gun is driven to the rear with a force equal to the force with which the bullet or shot is driven forward. This rearward force is transmitted to the shooter's shoulder, as is well known. As is also known, the gun stock is designed for the shooter to place his or her cheek against the stock in order that the eye of the shooter can sight along the top surface of the barrel, through or on top of the sights placed thereon. This customary arrangement involves the top surface of the gun stock being at least two inches below the centerline of the barrel, and therefore two or so inches below the line of force at the time the gun is fired.

This difference in the line of force and the position of the gun stock creates a moment arm or couple that will cause the gun muzzle to rise or jump at the time the gun is fired, and this will often cause the gun stock to be driven up against the shooter's cheek bone.

Consequently, it is one of the important purposes of my invention to design a recoil pad having the characteristic of causing a downward and outward deflection of the stock away from the shooter's face at the time the gun is fired, with the amount of such deflection being readily adjustable by the user.

SUMMARY OF THIS INVENTION

It is an important goal of my invention to design a shoulder pad, otherwise known as a recoil pad or butt plate, of highly advantageous construction, using durable material that is nevertheless sufficiently soft and pliable as to enable the stock of the shotgun or rifle to fit and conform very comfortably to the shooter's shoulder. In addition, and quite importantly, the action of the shoulder pad may be modified by the shooter in order to adjust the amount of energy absorption that is obtained. My novel pad utilizes a number of essentially parallel slots extending from side to side through the pad at a downwardly inclined compound angle, such that the recoil of the shotgun or rifle will result in the stock of the gun undertaking a distinct movement down and away from the cheekbone of the shooter. By compound angle I am referring to the slots being at an angle to each of two orthogonally disposed, intersecting planes.

My invention involves the judicious selection of a material possessing desired shock absorbing attributes, as well as the appropriate configuration of the cross section of the pad to make available a selected number of slots disposed at a desirable compound angle. Into such slots, selected amounts of absorbent material can be inserted by the shooter, such that the amount of energy absorption by the pad can be carefully controlled.

Although I am not to be limited to a certain material, I have found that an elastomer developed by certain companies to meet the requirements of the aerospace industry, to be highly suitable for use in the creation of my recoil pads. These elastomers have high tensile strength as well as high tear strength, and these characteristics coupled with low compression or flow characteristics and little if any change in response to temperature fluctuations make them my preferred choice of material.

My basic device thus utilizes a highly advantageous design in which the material between the series of angled slots define struts which are disposed at a compound angle, thus allowing the recoil pad to act like a "universal joint" or "gimbal" in order to enable the maximum amount of bearing area to fit against the shooter's shoulder.

Also, I preferably modify the characteristics of the elastomers so as to make a significant change in the molecular structure of the finished product. I may, for example, bring about the entrapment of a large number of tiny air bubbles in the elastomer before it is molded into the shape of the recoil pad. As a result, the preferred embodiment of my pad will conform to the shooter's shoulder by permitting an initial compression of 20% to 25% upon the gun being raised and the pad placed firmly against the shoulder. Part of this conformation of the pad to the selected shoulder is as a result of the choice of elastomer, plus the modification of the elastomer, in addition to which I further the goal of providing a truly conformable pad by creating the previously mentioned series of elongate, generally parallel slots or holes along the length of the pad, which slots are disposed through the pad in a generally left-right direction and at a suitable compound angle. It is between these slots that my novel struts are disposed.

I am aware that others have created recoil pads with holes extending part of the distance between the gunstock and the part of the pad in contact with the shoulder. However, previous shoulder or recoil pads were not constructed so as to make full use of the elongate pad portions residing between the slots or holes, which portions, as mentioned above, I prefer to call struts. Into the slots that create the struts, a desirable amount and configuration of elastomeric material can, in accordance with this invention, be inserted.

It should now be clear that in accordance with this invention I dispose the struts in the shoulder or recoil pad in a generally parallel relationship, with these struts angled downwardly in two directions so as to define a compound angle. One of these directions is generally downwardly in the vertical plane in which the bullet or shot will travel, and the other direction is downwardly at right angles (orthogonal) to the first direction, thus being away from the shooter's shoulder. As a result, the angling of these struts in two orthogonal directions serves to create a resultant vector that directs the gunstock down and away from the shooter's face at the time the gun is discharged.

Although I am not to be limited to certain angles, I prefer for these struts to reside in a plane that is downward at say a 20° angle to the horizontal when considering the direction in which the bullet will travel, as well as downward at approximately the same angle away from the plane of the gun, but it is to be understood that the range of each of these angles can be between 5° and 30°±5°. Quite obviously, the angle the struts bear with respect to each of the two orthogonal directions need not be the same.

Typically, a rifle or shotgun delivers 15 to 60 foot pounds of recoil force at the time it is fired, and I have found that my new recoil pad will absorb 25% to 35% of that force. Also, and most advantageously, my pad will spread the recoil force over a broader area of the shoulder that the shooter uses, than did the prior art devices.

My recoil pad can be mounted on the end of the gunstock by any of several means, but I prefer to bond a relatively hard plastic or metal plate to my novel pad such that this plate can directly contact the end of the stock. Preferably two holes are created in the mounting plate, through which a pair of comparatively short screws can extend, with the threads of the screws firmly engaging the wood or plastic of the gunstock.

It should now be apparent that when my novel shoulder pad is equipped with struts disposed downwardly at a compound angle, the pad is intended to be fired from a designated shoulder, so that the stock of the gun will tend to move away from, rather than toward the cheek of the shooter, in addition to moving downwardly.

It is a principal object of my invention to provide a recoil pad for a shotgun or rifle, that will be durable yet possess energy absorbing characteristics that may be selectively and readily varied by the shooter.

It is another object of my invention to provide a recoil pad having a number of generally parallel struts therein, with these struts possessing a compound angle, in that they angle downwardly as well as away from the shooter, thus to develop a resultant force vector causing the gun stock to move both downwardly as well as sidewardly away from the cheekbone of the shooter at the time the gun is fired, thus not only minimizing any chance of the gunstock impacting the cheekbone of the shooter, but also dispelling any tendency for the shooter to flinch at the time of pulling the trigger.

It is still another object of my invention to provide a recoil pad of an elastomeric material that has been suffused with a large number of tiny air bubbles, that cause the pad to be so comparatively soft that it will conform readily to the configuration of the shooter's shoulder, with the amount of energy absorption of the pad being able to be varied at the behest of the shooter.

It is yet another object of my invention to provide a recoil pad having a number of elongate holes or slots therein, resulting in the creation of generally parallel, angled "struts" extending between fore and aft portions of the shoulder pad, with these struts being disposed at a compound angle such that a downward and outward component of the recoil force is developed, and with the holes or slots being able to receive strips of elastomer, or any other suitable material, such that the amount of energy absorption can be selectively varied.

It is yet still another object of my invention to provide a recoil pad whose configuration is responsible for building the confidence of the shooter, in that there is little likelihood of the shooter's face being struck by the gunstock, and hence the elimination of events that would tend to make a shooter flinch at the time the trigger is pulled.

These and other objects, features and advantages of my invention will become more apparent as the description proceeds.

DETAILED DESCRIPTION

Figure 1:
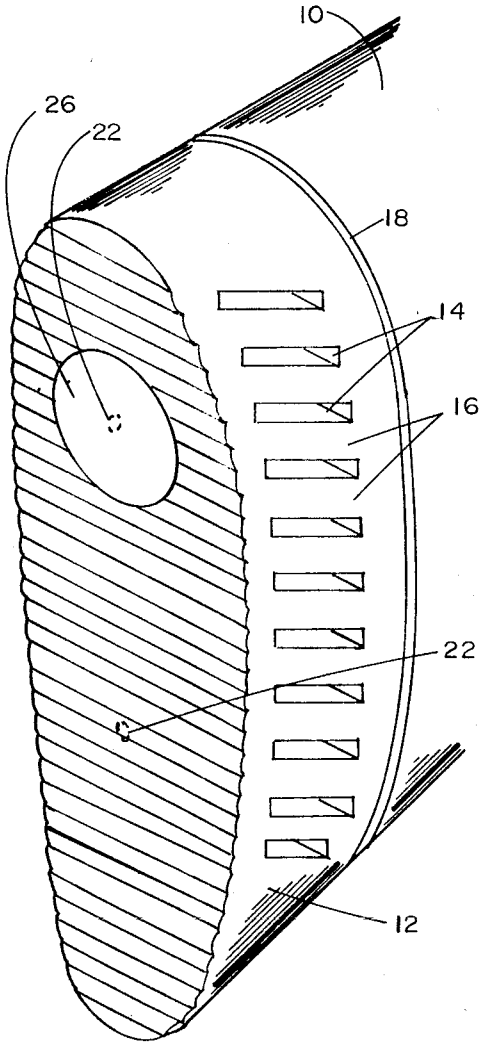
FIG. 1 is a perspective view of the rear part of a gunstock equipped with my novel recoil pad.

Turning to FIG. 1, it will be seen that I have depicted the rear portion of the stock 10 of a shotgun or a rifle, attached to which is my new recoil pad or butt plate 12. As will be developed hereinafter, this recoil pad is formulated and configured such that it will readily conform to the shooter's shoulder, and provide a substantial amount of recoil absorption.

Figure 2:
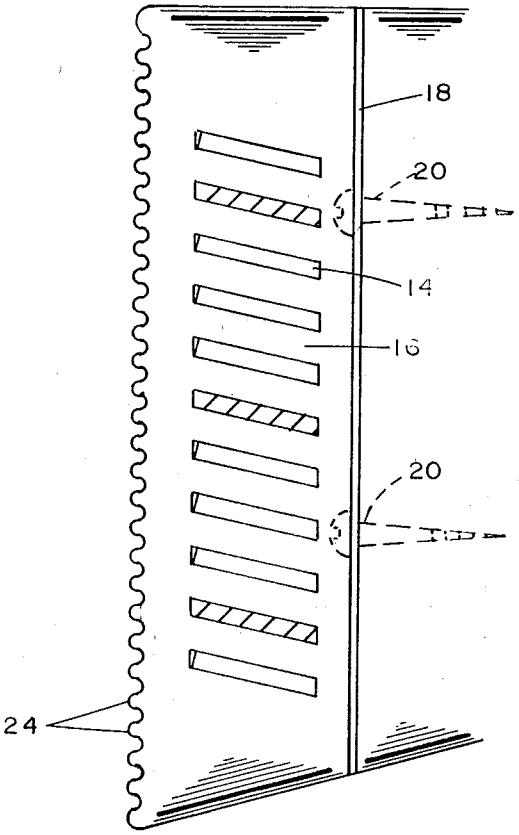
FIG. 2 is a side elevational view of the rear portion of the gunstock, showing how the shoulder pad can be secured to the gunstock.

As shown in FIG. 1 as well as FIG. 2, my recoil pad is provided with a substantial number of angled, elongate slots or holes 14, that are disposed in a generally parallel, vertical array between the upper and lower extremities of the pad. These holes extend from side to side entirely through the pad, and are spaced a distance apart so as to define a plurality of "columns" or "struts" 16 that extend generally outwardly as well as downwardly when considered with reference to the plane of the gun and shooter, and with regard to the direction of the travel of the bullet or shot.

As will be seen hereinafter, these slots or holes are of a uniform size, so that one or more strips of elastomeric material can be placed therein at selected locations, such that the amount of energy absorption of the pad can be readily varied, in order to meet the shooter's own particular requirments. FIG. 2 reveals by the three hatched rectangles, the placement that may be utilized for three inserts, such as of elastomeric material, into selected slots.

Although other arrangements may be utilized, I prefer to bond or cement a plastic or metal plate 18 on the forwardmost surface of the recoil pad, which plate is the same size as the recoil pad and the rear surface of the gunstock. This plate may be on the order of 0.060" to 0.090" in thickness, and is provided with a pair of holes therein, such that the recoil pad may be attached to the stock of the rifle or shotgun by the use of a pair of screws 20.

I prefer to mold a pair of holes at selected locations disposed on the vertical centerline of the pad, as indicated at 22 in FIG. 1, which holes are of course in alignment with the holes created in the plate 18 for the receipt of the mounting screws 20. Although the heads of the screws are somewhat larger than the holes through the pad and mounting plate, the elastomer of which I make the pad 12 is sufficiently pliable as to readily permit the insertion of the screws 20 to the location at which the underside of the screwheads are in contact with the mounting plate 18, as indicated in FIG. 2.

To provide the pad with non slip characteristics, I prefer to provide a series of generally horizontal, parallel ribs 24 on the rear side of the pad, as best seen in FIGS. 1 and 2. A logo 26 may be utilized on the rear surface of the recoil pad if desired.

Figure 3:
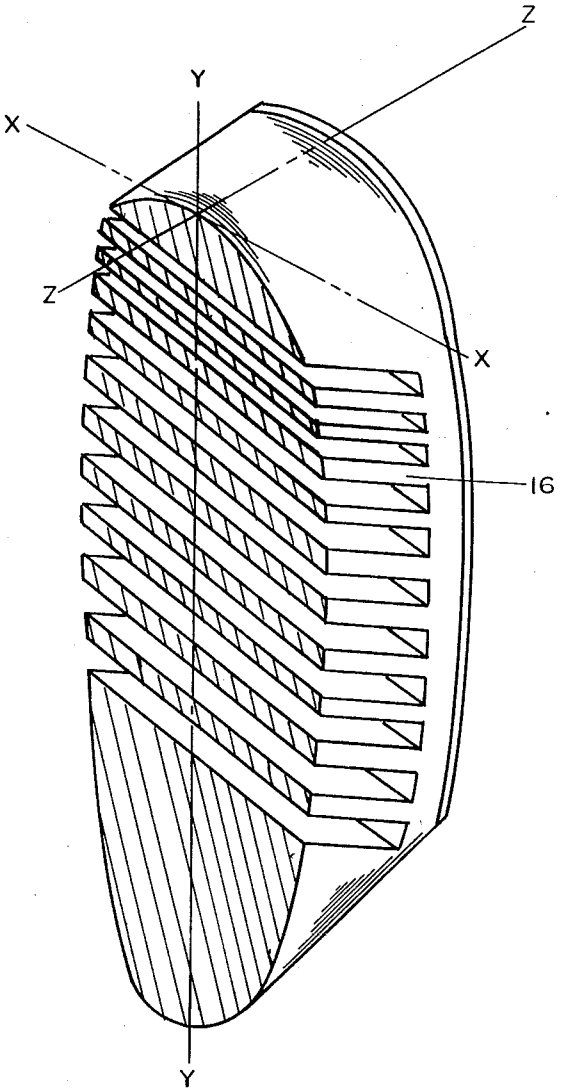
FIG. 3 is a perspective view similar to FIG. 1 except that the rearmost surface has been removed in order to indicate a preferred compound angle of the elongate slots used in my recoil pad, square-ended slots in this instance, and therefore the preferred compound angle of the struts created between the slots.
Figure 10:
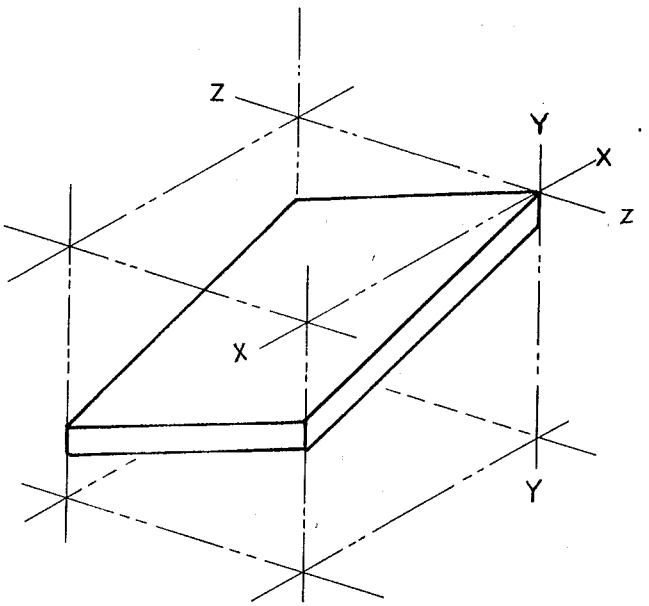
FIG. 10 is a free body diagram similar to FIG. 9, but of the configuration suitable for a right handed shooter.
Figure 9:
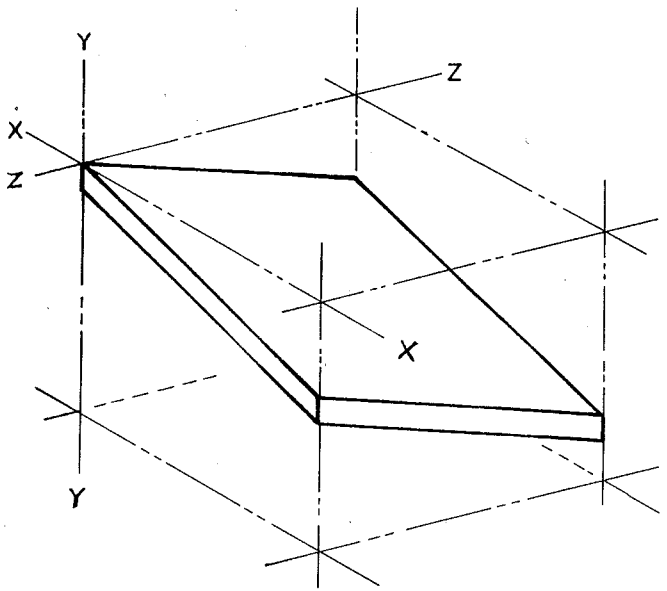
FIG. 9 is a free body diagram associated with a single exemplary strut placed so as to be advantageous to a left handed shooter.

FIG. 3 reveals the compound angling of the sturts 16, but with particular reference to FIGS. 9 and 10, it is to be seen in these fragmentary perspective views that I have revealed exemplary struts or columns to a comparatively large scale, so that the preferred compound angling of the struts will be readily apparent. It is to be noted that not only do the struts 16 angle downwardly in the YZ plane away from the horizontal or XZ plane, but also the near edge of the struts angle downwardly in the XY plane away from the XZ plane, thus amounting to a compound angle. I am not to be limited to any particular angle, but I prefer for the angle at which the struts reside in each plane to be between 5° and 30°, and preferably at approximately 20° to the horizontal in both of these orthogonally disposed directions. However, there is no requirement that the angle with respect to both orthogonal directions be identical.

Thus it is to be seen that the struts angle downwardly with respect to two intersecting orthogonally disposed planes, at what I prefer to call a compound angle.

If the angle is as low as say 5° to the horizontal, the struts are too rigid at the time the gun is discharged, providing too small an amount of attentuation of the recoil force. On the other hand, if the angle the struts bear to the horizontal is say over 30°, the struts lose so much rigidity as to fail to provide a desirable amount of resistance to act as an effective shock absorber when the gun is discharged.

Although I am not to be limited to any particular dimension of shoulder pad or recoil pad, typically I prefer for the pad to be between three fourth inch ($\frac{3}{4}$") and one and one-half ($1\frac{1}{2}$") in thickness in the fore and aft direction, which is the left-right direction as the pad is viewed in FIG. 2.

Preferably, the slots 14 are approximately one half inch to seven eighths inch in length, and one eight to three eights inch in width, although I am not to be limited to this. The slots extend entirely through the pad from side to side, and are preferably three sixteenths inch to seven eights inch apart, thus determining the preferred size of the struts thus created.

Figure 4A:
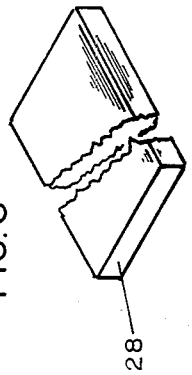
FIG. 4*a* is a fragmentary perspective view of typical strip material that is inserted by the shooter at selected locations in the slots of the shoulder pad.
Figure 4:
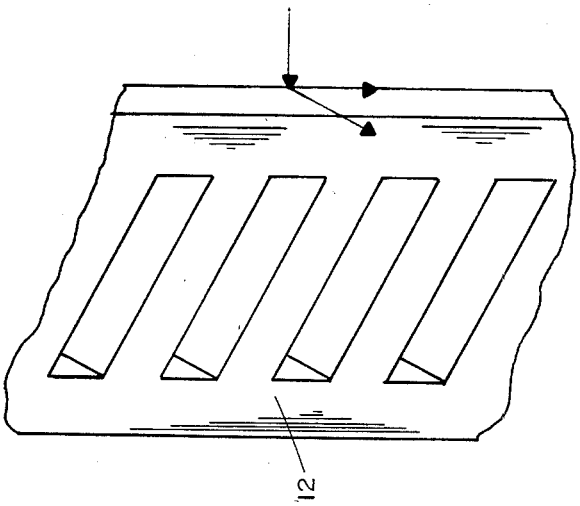
FIG. 4 is a fragmentary view to a substantially larger scale to reveal how the angled slots serve to create struts disposed at a compound angle, and also showing a force diagram representing the downward forces associated with the firing of the gun.

Referring to FIG. 4, it will be noted that I have provided a somewhat enlarged view showing the slots and the struts created thereby, with the adjacent vector representing the downward force created by the gimballing type action brought about by the placement and angle of the struts 16. The vector depicts the downward motion of the gunstock away from the shooter's face, thus diminishing the likelihood of injury or abrasion at the time of gun discharge.

FIG. 4*a* is a fragmentary showing of typical strip material I may use for insertion into selected slots of my novel recoil pad.

Figure 5:
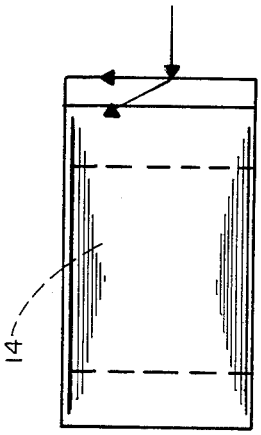
FIG. 5 is a view constructed to a scale similar to that of FIG. 4, but viewing the shoulder pad from above, and revealing the force diagram representing the sideward forces associated with the firing of the gun.

Directly above FIG. 4 is FIG. 5, wherein is to be seen the dashed lines representing the slot location, as well as the resultant arrow representing the movement of the stock away from the shooter's face as a result of the compound angling of the slots.

Figure 6:
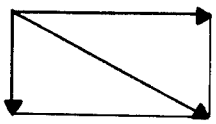
FIG. 6 is a force diagram revealing a generally horizontal vector depicting the force of a gun at time of discharge, with the downwardly angled vector representing the downward force created by the compound angled struts.

Turning to FIG. 6, a force diagram larger than that illustrated in FIG. 4 is revealed, showing to a larger scale, the resultant arrow representing the forces causing the gunstock to move downwardly at the time the gun is fired.

Figure 7:
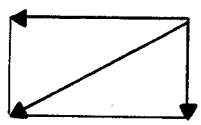
FIG. 7 is a force diagram revealing a generally horizontal vector depicting the force of the gun at the time of discharge, with the sideward angled vector representing the sideward force created as a result of the struts being disposed at a compound angle.

Directly above FIG. 6 is FIG. 7, representing a force diagram of FIG. 5 to a larger scale, the resultant arrow representing the force resulting in the movement of the gunstock away from the shooter's face as a consequence of the compound angling of the slots.

Figure 8:
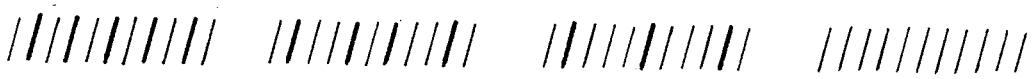
FIG. 8 is a schematic representation of how the insert material can be readily added to my pad in any of a number of different configurations.

Now turning to FIG. 8, it will be noted that I have provided a representation of the manner in which a shooter may go about varying the energy-absorbing characteristics of the recoil pad in order to meet a particular need. The elastomeric material I prefer to use may be in strips, as generally shown in FIG. 4*a*, and after being inserted into selected slots, can then cut to length. The fit is so close that no form of glue or cement is usually needed.

As shown in the bottom portion of FIG. 8, my recoil pad can have, for example, eleven slots, in which no strips are utilized. Such a pad configuration would be suitable for use in a gun using light field loads, 20 gauge shotguns, or $2\frac{3}{4}$ to 3 dram shells, and small caliber rifles. In the next suggested configuration, wherein three darkened portions indicate that three strips are used, this configuration would be suitable for use in 12 gauge shotguns utilizing high brass shells, which contain 3 to $3\frac{3}{4}$ dram shells.

Four strips may be utilized in the slots of the shoulder pad when, for example, three inch magnum shells are utilized in a 12 gauge shotgun, whereas five or more strips, as indicated at the top of FIG. 8, may be utilized when using a 10 gauge shotgun with magnum shells, or in connection with 0.458 caliber rifles.

The elastomer I typically use is identified as having a silicone base, the elastomer being manufactured by General Electric Company or Dow Corning Co.

In order to cause a desirable percentage of the elastomer to contain tiny air bubbles, I pour the elastomer into a mixing vessel, and then proceed to stir for three minutes while maintaining a preferred temperature of 70° F. to 80° F. After thorough mixing, I then pour the elastomer into a mold made of metal, and place in a curing oven maintained at approximately 200° F. for approximately 30 minutes. In order to be able to remove the shoulder pad easily from the mold, I use a plastic spray as a mold release. However, I am not to be limited to this procedure.

The plate 18 is typically secured to the forward flat face of the recoil pad by the use of silicone cement.

Importantly, the completed recoil pad contains a large number of closed cell bubbles, and the pad is non-hygroscopic. I prefer for the air bubble volume not to exceed approximately 25% of the total recoil pad volume, excluding slot volume. I prefer for the bubbles to be 0.001" to 0.010" in diameter.

As should now be apparent, I have provided a highly satisfactory recoil pad for rifles or shotguns, having qualities of comfort as well as adjustability, and serving to prevent abrasion or injury to a shooter's face. Because the pad is relatively soft, it conforms readily to the shooter's shoulder, assuring a large contact area, and thereby bringing about much less recoil pressure than would have been the case in the event a relatively hard pad has been used.

As to the procedure of balancing the recoil pad to conform to the shooter's method of mounting the gun to his shoulder, the type & weight of the gun, and the various possible shell loads, I can easily modify or adjust the energy absorbing characteristics of my shoulder pad, such that the pad will have additional stiffness, or greater softness, in accordance with actual firing conditions.

As should now be very clear, the basic characteristics of my novel recoil pad can be changed by insertion of elastomer strips, or strips of other suitable material, which would be placed into slots at such locations as to be most beneficial, and used in a quantity appropriate to the weight of gun and powder charge.

As an indication of the number of combinations that could be derived by the use of a recoil pad with eleven slots, and the insertion of one to five strips into the slots of the pad, refer to the following formula taken from the Mathematical Tables included in the Handbook of Chemisiry & Physics.

N=number of slots
K=number of strips
!=factorial of number
C≃number of combinations $$C = \frac{N!}{K!\,(N-K)!} = \frac{(11)!}{(5)!\,(11-5)!} = 462 \text{ Combinations}$$

Turning again to FIG. 9, it will be seen that I have there depicted a free body diagram representative of the compound angling of the slots. The X coordinate appearing in this figure represents in a horizontal plane, the left-right or side-to-side dimension; the Z coordinate represents the side plane fore and aft dimension; and the Y coordinate represents the vertical plane or up and down dimension. Consequently, the gun may be regarded as residing in the YZ plane, with the bullet or shot traveling in that plane.

This particular diagram represents the angling of the large, exemplary strut for a left handed shooter, that is, a shooter that will place the shoulder pad of the gun against his or her left shoulder. As will be seen, the forward edge of this greatly enlarged exemplary strut depicted in this figure is rotated downwardly with respect to the horizontal or XZ plane, with the right hand side edge of the strut also rotated downwardly in the Y direction with respect to the XZ plane. I have found that the forward edge of this strut can be rotated downwardly with respect to the XZ or horizontal plane from 5° to 30°, plus or minus 5°, and similarly, the near side edge of the strut can be rotated downwardly with respect to the horizontal plane from 5° to 30°, plus or minus 5°.

As will be apparent from a study of this figure, this compound angling of the strut is advantageous for a left-handed shooter, for as a result of strut angle, the stock of the gun is caused to move downwardly and to the left at the time the gun is fired, thus causing the gunstock to undertake a distinct motion away from the face of the shooter. This is in sharp distinction to an angling of the struts only downwardly, for I found that by the struts only being angled downwardly, the gunstock tended merely to move downwardly along the skin of the shooter's face, whereas a proper compounding of the angle of the struts causes the stock to actually rotate away from the shooter's face and greatly lessen the likelihood of the gunstock striking the shooter's cheekbone.

In FIG. 10 I depict a free body diagram of an exemplary strut disposed at an angle proper for a right handed shooter, that is, one who places the shoulder pad of the gun on his or her right shoulder. As is obvious, the shooter can readily modify the softness of the shoulder pad in accordance with this invention, merely by inserting a selected number of strips of elastomeric material into the slots of the shoulder pad, at the most desirable locations.

It is realized that the use of my invention involves the construction of shoulder pads particularized for use with the designated shoulder of a shooter, that is, the compound angle is selected to cause the gunstock to move away from the cheek of the shooter that corresponds to the shoulder from which the gun is fired.

I claim:

1. An adjustable shoulder pad for use on the end of the stock of a rifle or shotgun, said pad being particularized for use on a designated shoulder and containing a number of generally parallel, elongate slots extending from side to side through said pad, said slots angling downwardly with respect to two orthogonal directions, and being of an essentially consistent size and configuration, such that into said slots, a selected amount of material of a nature to absorb energy may be inserted, a plurality of elongate struts defined by the slots, which struts tend to bend and buckle somewhat at the time the shooter places the pad firmly against his shoulder so as to cause the pad to conform to the configuration of this shoulder, said struts then buckling to a significantly greater extent at the time the gun is fired, said struts, by their placement and angle, causing a significant amount of movement of the stock down as well as away from the shooter's face at the time the gun is fired.

2. The adjustable shoulder pad as defined in claim 1 wherein the tendency of said struts to buckle at the time of firing is directly affected by the stiffness imposed on the pad by the insertion of preascertained amounts of energy-absorbing material into said slots.

3. The adjustable shoulder pad is defined in claim 1 in which said pad is constructed of an elastomer that contains a large number of tiny, closed cell bubbles, the air bubble volume not exceeding approximately 25% of the total recoil pad volume, excluding slot volume.

4. The adjustable shoulder pad as defined in claim 1 in which said energy-absorbing material to be inserted into said slots is in strip form.

5. The adjustable shoulder pad as defined in claim 1 in which said slots are disposed at an angle to the horizontal, such angle being between 5° and 30°.

6. The adjustable shoulder pad as defined in claim 1 in which the slots can be between approximately $\frac{1}{2}''$ to $\frac{7}{8}''$ in length, and $\frac{1}{8}''$ to $\frac{3}{8}''$ in width.

7. The adjustable shoulder pad as defined in claim 1 in which the struts defined between the slots can be between 3/16" to $\frac{7}{8}''$ in thickness.

8. An adjustable shoulder pad for a rifle or shotgun having a plurality of angled, elongate slots of an essentially consistent configuration, said slots being disposed in a generally parallel array between the fore and aft surfaces of said pad, that extend through the pad, said slots being disposed at an angle of between 5° to 30° to the horizontal, considered in two orthogonal directions, said slots being spaced on the order of 3/16" to $\frac{5}{8}''$ apart, thus to define a plurality of struts angling downwardly at a compound angle from the shooter's shoulder when considered in the general direction of the intended path of the bullet or shot, one or more of said slots being adapted to receive insertions of energy-absorbing material, such insertions making it possible for the user to selectively vary the energy absorption characteristics of the shoulder pad, by decreasing the tendency of said struts to buckle, whereby the stock moves down and away from the shooter's cheek at the time the gun is fired.

9. The adjustable shoulder pad as defined in claim 8 in which the pad is constructed of an elastomer in which approximately 25% of its volume is constituted by tiny air bubbles.

10. The adjustable shoulder pad as defined in claim 8 in which said energy-absorbing material is provided in strip form.

11. The adjustable shoulder pad as defined in claim 8 in which the slots are between approximately $\frac{1}{2}''$ to $\frac{7}{8}''$ in length, and $\frac{1}{8}''$ to $\frac{3}{8}''$ in width.

12. An adjustable shoulder pad for use on the rear end of the stock of a rifle or shotgun, said pad being particularized for use only from a designated shoulder, being constructed of an elastomer, containing a number of generally parallel, elongate slots of an essentially consistant configuration, and extending from side to side through said pad, into which slots, material of a nature to absorb energy may be inserted, said slots angling downwardly with respect to two orthogonal directions so as to define a compound plane, with one of said directions being in the general direction the bullet or shot is to travel, and the other being in a direction away from the shooter, a plurality of elongate struts defined by the slots, which struts tend to bend and buckle somewhat at the time the shooter places the adjustable shoulder pad against his shoulder so as to cause the pad to conform to the configuration of his shoulder, said struts then buckling to a significantly greater extent at the time the gun is fired, the tendency of said struts to buckle at the time of firing being directly affected by the stiffness imposed on the pad by the insertion of preascertained numbers of strips of energy-absorbing material into said slots.

13. The adjustable shoulder pad as defined in claim 12 wherein said struts, by their placement and angle, cause a significant amount of movement of the stock down and away from the shooter's face at the time the gun is fired.

14. The adjustable shoulder pad as defined in claim 12 in which the elastomer contains a large number of tiny, closed cell bubbles, the air bubble volume not exceeding approximately 25% of the total adjustable shoulder pad volume, excluding slot volume.

15. The adjustable shoulder pad as defined in claim 12 in which the slots are disposed at an angle to the horizontal, such angle being between 5° and 30°.

16. The adjustable shoulder pad as defined in claim 12 in which the slots are between approximately $\frac{1}{2}''$ to $\frac{7}{8}''$ in length, and $\frac{1}{8}''$ to $\frac{3}{8}''$ in width.

17. The adjustable shoulder pad as defined in claim 12 in which the struts defined between the slots are between 3/16" to $\frac{7}{8}''$ in thickness.

18. An adjustable shoulder pad for a rifle or shotgun constructed to be fired from a designated shoulder of a shooter, said pad having a plurality of angled, elongate slots extending in a generally parallel array through said pad, said slots being disposed downwardly at an angle of between 5° to 30° to the horizontal with respect to two intersecting orthogonally disposed planes, with one of such planes being in the direction in which the bullet or shot is to travel, and the other commencing at the shoulder from which the shooter is to fire the gun, and leading away from the shooter's body, said slots being spaced on the order of 3/16" to $\frac{7}{8}''$ apart, thus to define a plurality of struts angling downwardly from the shooter's shoulder at a compound angle, said slots being adapted to receive one or more insertions of energy-absorbing material provided in strip form, such insertions making it possible for the user to selectively vary the energy absorption characteristics of the pad.

19. The shoulder pad as defined in claim 18 in which the pad is constructed of an elastomer in which approximately 25% or less of its volume is constituted by tiny air bubbles.

20. The shoulder pad as defined in claim 18 in which the slots are between approximately $\frac{1}{2}''$ to $\frac{7}{8}''$ in length, and $\frac{1}{8}''$ to $\frac{3}{8}''$ in width.

* * * * *